United States Patent [19]

Klein et al.

[11] 3,973,757

[45] Aug. 10, 1976

[54] SILO FOR MIXING AND HOMOGENIZING BULK MATERIAL

[75] Inventors: Hans Klein, Beckum; Horst Ritzmann, Enniger; Peter Kremerskothen, Ennigerloh, all of Germany

[73] Assignee: Polysius AG, Neubeckum, Germany

[22] Filed: Mar. 26, 1975

[21] Appl. No.: 562,061

[30] Foreign Application Priority Data

Apr. 10, 1974 Germany ..... 2417468

[52] U.S. Cl. ..... 259/4 R; 259/DIG. 17

[51] Int. Cl.[2] ..... B01F 15/00

[58] Field of Search ..... 259/4 R, 18, 36, 60, 259/DIG. 17; 222/478

[56] References Cited

UNITED STATES PATENTS

| | | | |
|---|---|---|---|
| 3,029,986 | 4/1962 | Horn et al. | 222/478 |
| 3,258,252 | 6/1966 | Lanier | 259/95 |
| 3,756,475 | 9/1973 | Emery | 259/4 R |
| 3,756,569 | 9/1973 | Wohlfarth | 259/4 R |

FOREIGN PATENTS OR APPLICATIONS

| | | |
|---|---|---|
| 1,507,888 | 3/1969 | Germany |

*Primary Examiner*—Peter Feldman
*Assistant Examiner*—Donald B. Massenberg

[57] ABSTRACT

A silo for mixing and homogenizing bulk material has an air permeable base above a mixing chamber having a volume less than that of the silo, the chamber also having an air permeable floor, and the chamber being in communication with the silo by at least one material inlet aperture and having at least one material outlet aperture.

8 Claims, 2 Drawing Figures

SILO FOR MIXING AND HOMOGENIZING BULK MATERIAL

In a known device of the type described (German Pat. No. 1,507,888) the mixing chamber, which is very small in relation to the size of the silo cavity, is centrally disposed in the silo cavity above the silo base. It is shielded in the direction of the silo cavity by a cone having material apertures at its lower edge. The material outlet aperture is central in the silo base, i.e., in general centrally below the small mixing chamber.

The main disadvantage of such a construction lies in the small volume of the mixing chamber which means that it is only possible for a relatively small amount of material to be mixed or homogenized in the mixing chamber at one time. For a given base area of the silo, the output of this known device is thus very limited.

If in an attempt to overcome this defect one were to increase the area of the mixing chamber at the expense of the area of the silo base not roofed in by the mixing chamber, the desired premixing effect in the silo cavity would become seriously affected. There would thus be a danger that without further aids to flow, large amounts of material would lie above the mixing chamber and hence reduce the amount of silo space usable.

If on the other hand one were to try to achieve a considerable increase in output for a given silo base area by increasing the height of the mixing chamber, this would involve much greater power consumption and the feed of material to the mixing chamber would deteriorate.

The invention thus has for a primary objective the avoidance of the defects referred to in developing a device of the type described for mixing and homogenizing bulk material, which for a given base area of the silo is notable for very high output and is suitable for continuous operation.

According to the invention this objective is attained in that the mixing chamber comprises a fluidizing chamber disposed below the base of the silo, and whose base area corresponds generally to that of the silo.

A silo constructed according to the invention has the advantage that the total base area available in the device can be used as the effective base area of the mixing chamber. The relatively large area thus available enables the mixing chamber to be operated as a genuine fluidizing chamber (fluidized bed chamber), which not only ensures an excellent mixing and homogenizing process but also enables operation to be continuous.

With the device according to the invention the height of the large area fluidizing chamber can be kept relatively small. It may for instance be 0.2 to 1.0 times, or preferably 0.4 to 0.6 times the diameter of the fluidizing chamber.

In a particularly preferred embodiment of the invention, the base of the silo is supported by a column passing centrally through the fluidizing chamber, the column having in its upper part a passage connecting the silo with the fluidizing chamber, and in its lower part an outlet conduit for the material. Such a column provides ready support for the base of the silo with the weight of the material loaded thereon, and results in a statically simple and effective construction.

In addition to the advantages described above the device provided by the invention and having a particularly large area fluidizing chamber has the further advantage of relatively low energy requirements, since the energy needed for fluidizing becomes less as the aerated base area becomes larger, for a given volume of mixing chamber.

Further details of the invention will appear from the following description of the two embodiments shown in the drawings, wherein.

Figure 1:
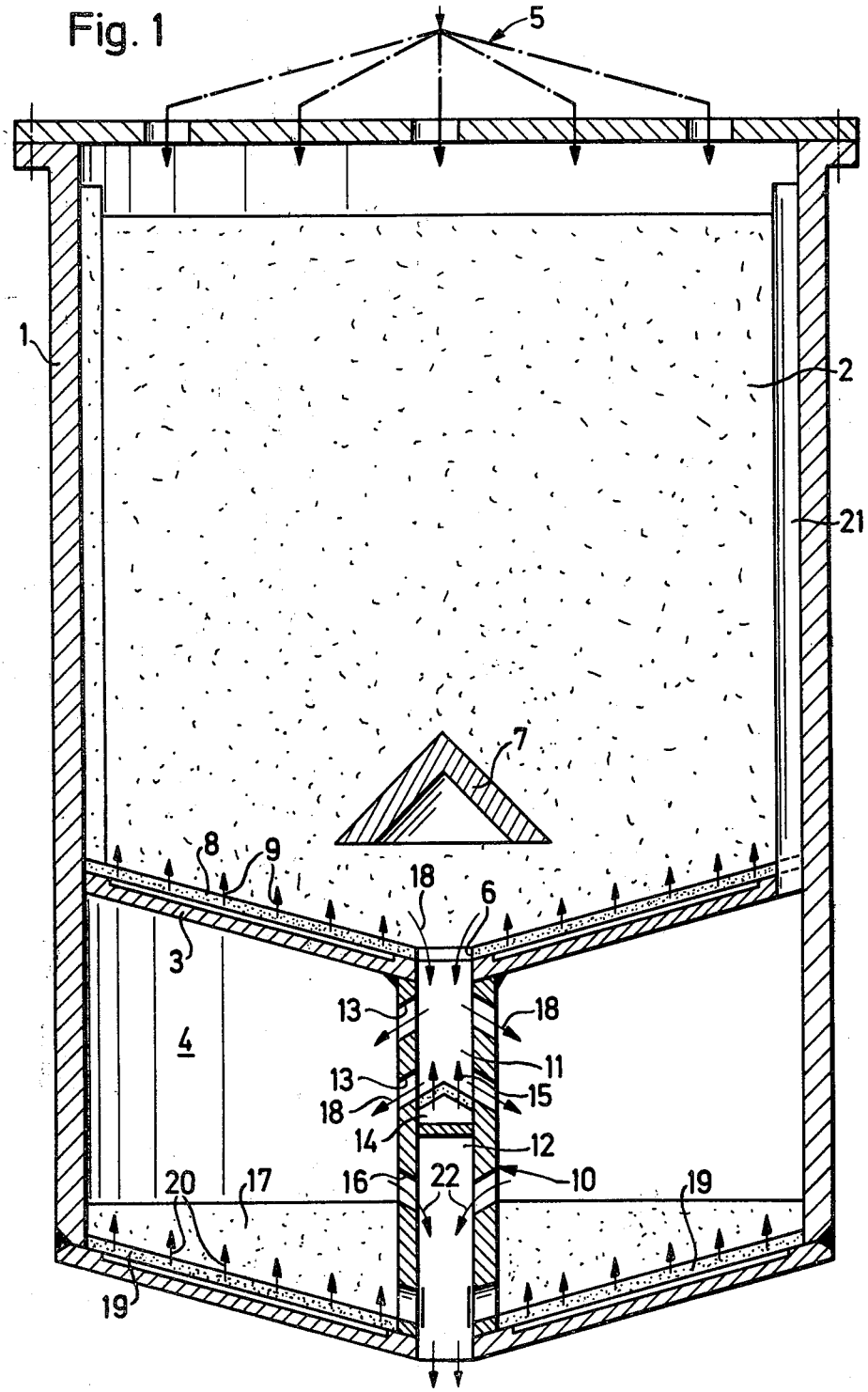
FIG. 1 is a vertical section through a first embodiment of the invention.

The device shown in FIG. 1 for the mixing and homogenizing of bulk material has a common housing 1 containing a silo 2 and a fluidizing chamber 4 disposed below the silo base 3.

The silo 2 is provided in normal manner with means 5, formed for instance as a distributor spider, for the supply of material, and also with a cone 7 shielding the central outlet aperture 6. The base 3 of the silo is aerated in normal manner via porous elements 8 (arrows 9).

The base 3 of the silo 2 is supported by a tubular column 10 passing centrally through the fluidizing chamber 4. Between the ends of the column the latter is blocked by a conical deflector 14 so as to divide the interior of the column into two conduits 11 and 12. Above the deflector the column wall has material passage apertures 13 which, together with the conduit 11, establish communication between the silo and the chamber 4, and similar material passage apertures 16 are provided in the wall of the column 10 below the deflector. The apertures 16 and the conduit 12 establish communication between the chamber 4 and the exterior of the latter, and the height of these apertures determines the level of the fluidized layer 17 formed in the chamber. If desired, the deflector 14 can be aerated (arrows 15).

In the operation of the device, the material supplied through the feed means 5 slowly moves down the silo 2, in which some preliminary mixing takes place. Because of the aeration of the silo base, the material flows along the base, inclined toward the center in the manner of a flat funnel, to the central outlet aperture 6, with the particles of material located in the area of this lowermost central zone being shielded by the cone 7 from the weight of the superimposed column of material. The material then passes through the passage 11 (arrows 18) into the fluidizing chamber 4, whose base is intensely aerated (arrows 20) in known manner. The air supplied for the purpose of aeration leaves the fluidizing chamber 4 via exhaust conduits 21. In this manner the material in the fluidizing chamber 4 is put into a condition resembling a fluidized bed and is thus very effectively mixed and homogenized. Finally the material flows away from the surface of the fluidized layer, through the apertures 16 and the outlet conduit 12 (arrows 22).

Figure 2:
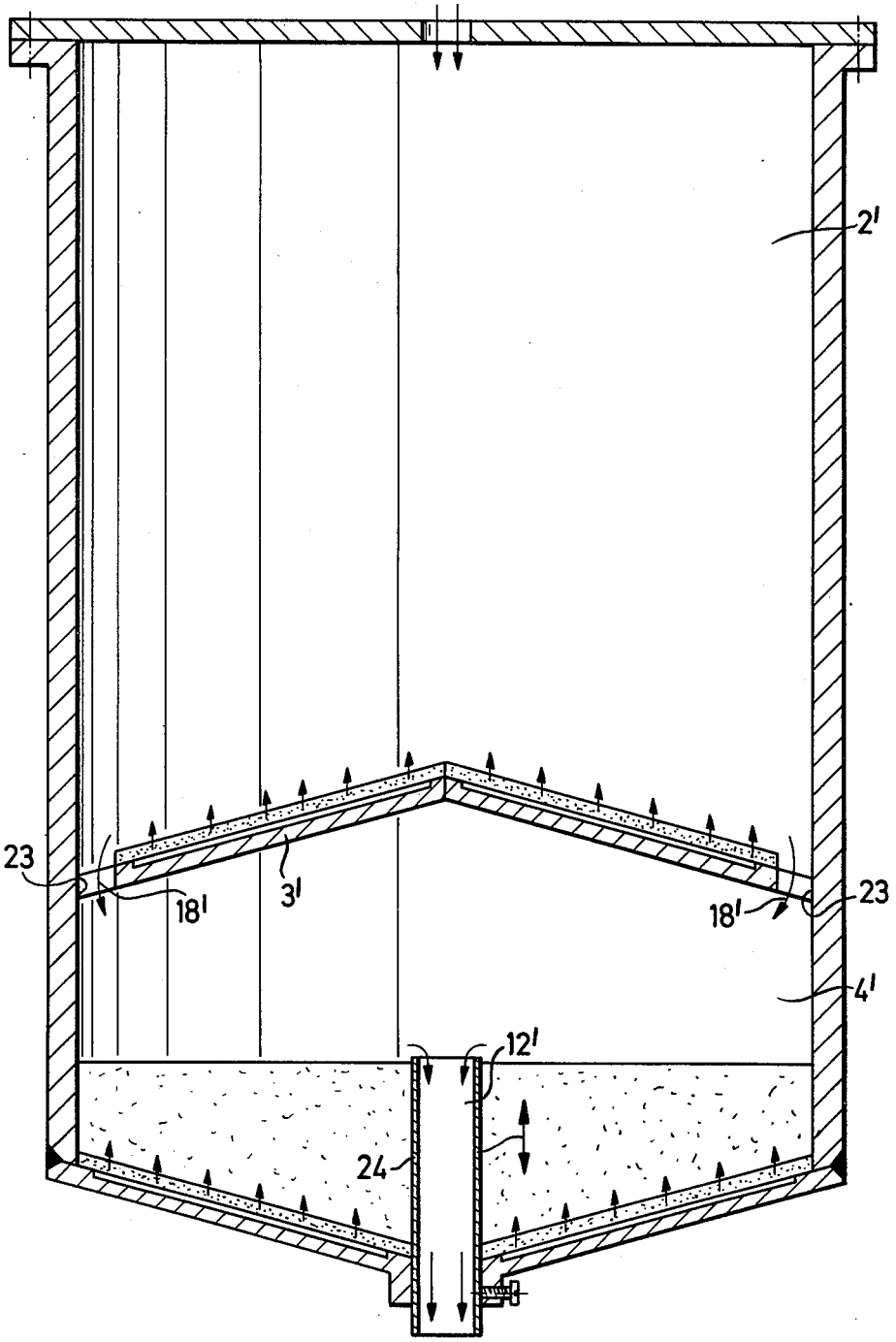
FIG. 2 is a vertical section through a second embodiment.

In the somewhat varied embodiment shown in FIG. 2, the air permeable base 3' of the silo 2' is formed as a flat cone with its apex directed upwardly toward the silo interior. At its outer edge this aerated base 3' has a plurality of material outlet apertures 23, whereby the material from the silo 2' enters the fluidizing chamber 4' (arrows 18').

The fluidizing chamber 4' is provided with an overflow pipe which constitutes the outlet conduit 12' and whose height, which determines the level of the layer in the fluidizing chamber 4', is preferably adjustable in a known manner.

This embodiment is again marked by a particularly large aerated base surface in the fluidizing chamber, and hence by high mixing and homogenizing efficiency, with low power consumption for a given silo base area.

The aeration of the silo base can be switched, if desired, from one sector to another, so that the material is withdrawn in sequence from different sectors into the fluidizing chamber. This ensures effective preliminary mixing.

The disclosed embodiments are representative of presently preferred forms of the invention, but are intended to be illustrative rather than definitive thereof. The invention is defined in the claims.

What is claimed is:

1. A device for mixing and homogenizing bulk material comprising a silo chamber and a mixing chamber separated by an aeratable base overlying the mixing chamber, said mixing chamber having a volume less than that of said silo chamber; material inlet passage means communicating between said mixing chamber and said silo chamber; an aeratable base for said mixing chamber having an area corresponding substantially to that of the base of said silo chamber and through which fluidizing air may pass into said mixing chamber; and material outlet means communicating with said mixing chamber.

2. A device according to claim 1 wherein the base of said silo chamber is supported by a tubular column extending centrally through said mixing chamber, said column having a deflector between its ends and having apertures above and below said deflector, said apertures constituting parts of said passage means and said outlet means.

3. A device according to claim 2 wherein said deflector is air permeable.

4. A device according to claim 2 wherein the base of said silo chamber is inclined in the form of a flat funnel toward said column.

5. A device according to claim 1 wherein the base of said silo chamber is formed as a flat cone having its apex extending upwardly, and wherein said material passage means comprises apertures at the periphery of said base.

6. A device according to claim 1 wherein the height of said mixing chamber is between 0.2 and 1.0 times the diameter of said mixing chamber.

7. A device according to claim 1 wherein the height of said mixing chamber is between 0.4 and 0.6 times the diameter of said mixing chamber.

8. A device according to claim 1 wherein said material outlet means comprises an overflow tube extending upwardly into said mixing chamber from its base.

* * * * *